US008035561B2

(12) United States Patent
Yamazaki et al.

(10) Patent No.: US 8,035,561 B2
(45) Date of Patent: Oct. 11, 2011

(54) COMMUNICATION APPARATUS

(75) Inventors: Tooru Yamazaki, Chita (JP); Yuji Sugimoto, Kariya (JP)

(73) Assignees: DENSO CORPORATION, Kariya (JP); Nippon Soken, Inc., Nishio (JP)

( * ) Notice: Subject to any disclaimer, the term of this patent is extended or adjusted under 35 U.S.C. 154(b) by 220 days.

(21) Appl. No.: 12/457,059

(22) Filed: May 29, 2009

(65) Prior Publication Data

US 2009/0295676 A1 Dec. 3, 2009

(30) Foreign Application Priority Data

May 30, 2008 (JP) ..... 2008-142664

(51) Int. Cl.
*H01Q 21/24* (2006.01)
*H01Q 3/24* (2006.01)

(52) U.S. Cl. ..... 342/361; 343/876

(58) Field of Classification Search ..... 342/361, 342/362, 372, 374, 437; 343/713, 876
See application file for complete search history.

(56) References Cited

U.S. PATENT DOCUMENTS

2008/0291097 A1 11/2008 Fukushima et al.

FOREIGN PATENT DOCUMENTS

| | | |
|---|---|---|
| JP | U-58-061509 | 4/1983 |
| JP | A-61-210705 | 9/1986 |
| JP | A-07-191132 | 7/1995 |
| JP | A1-10-145273 | 5/1998 |
| JP | A-2005-150848 | 6/2005 |

*Primary Examiner* — Dao Phan
(74) *Attorney, Agent, or Firm* — Posz Law Group, PLC

(57) ABSTRACT

A communication apparatus communicating other apparatuses includes: a switch for switching between a vertical polarized antenna and a horizontal polarized antenna; a communication device for transmitting and receiving the electric wave via one of the antennas, which is selected by the switch; a monitor for monitoring a relative distance between the apparatus and other apparatuses; and a controller for controlling the switch such that the switch selects the vertical polarized antenna when the relative distance is equal to or larger than a distance threshold, and the switch selects the horizontal polarized antenna when the relative distance is smaller than the distance threshold. The distance threshold is larger than a distance between the apparatus and a dip point.

5 Claims, 3 Drawing Sheets

COMMUNICATION APPARATUS

CROSS REFERENCE TO RELATED APPLICATION

This application is based on Japanese Patent Application No. 2008-142664 filed on May 30, 2008, the disclosure of which is incorporated herein by reference.

FIELD OF THE INVENTION

The present invention relates to a communication apparatus for communicating with other communication apparatus.

BACKGROUND OF THE INVENTION

Conventionally, a communication apparatus is mounted on a vehicle. The apparatus includes multiple antennas, each of which receives an electric wave. The apparatus selects one of antennas, which receives the wave with high quality, so that the apparatus provides a diversity antenna system.

When a communication apparatus only includes one antenna, the antenna has directionality so that communication quality is improved. This technique is disclosed in JP-A-2006-314071 corresponding to US 2008/0291097.

However, in the diversity antenna system, it is necessary to include multiple antennas, so that dimensions of the apparatus become large. Further, in the technique disclosed in JP-A-2006-314071, although the dimensions of the apparatus are small, the communication may be interrupted when the apparatus is disposed at a dip point, at which receiving electric power is much reduced. Here, at the dip point, the receiving electric power is reduced by influence of multiple paths caused by reflection of the electric wave on a road surface or a wall of a building in a city since the antenna has the directionality.

Thus, it is required to provide a communication apparatus with small dimensions and without receiving influence of a dip point.

SUMMARY OF THE INVENTION

In view of the above-described problem, it is an object of the present disclosure to provide a communication apparatus with small dimensions and without receiving influence of a dip point.

According to a first aspect of the present disclosure, a communication apparatus mounted on a vehicle and communicating other apparatuses includes: a switch for switching between a vertical polarized antenna and a horizontal polarized antenna, wherein the vertical polarized antenna transmits and receives an electric wave, which has a polarization surface perpendicular to a ground surface, and the horizontal polarized antenna transmits and receives the electric wave, which has another polarization surface in parallel to the ground surface; a communication device for transmitting and receiving the electric wave via one of the vertical polarized antenna and the horizontal polarized antenna, which is selected by the switch; a monitor for monitoring a relative distance between the apparatus and other apparatuses; and a controller for controlling the switch in such a manner that the switch selects the vertical polarized antenna when the relative distance is equal to or larger than a distance threshold, and the switch selects the horizontal polarized antenna when the relative distance is smaller than the distance threshold. The distance threshold is larger than a distance between the apparatus and a dip point.

The above apparatus has small dimensions without additional circuit. Further, the apparatus is not affected by influence of the dip point, so that the apparatus communicates with other apparatuses sufficiently.

According to a second aspect of the present disclosure, a computer readable program storage medium contains instructions being readable and executed by a computer. The instructions cause the computer to function as the communication apparatus according to the first aspect.

The above medium provides the apparatus with small dimensions without an additional circuit. The apparatus is not affected by influence of the dip point, so that the apparatus communicates with other apparatuses sufficiently.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

First Embodiment

Figure 1:
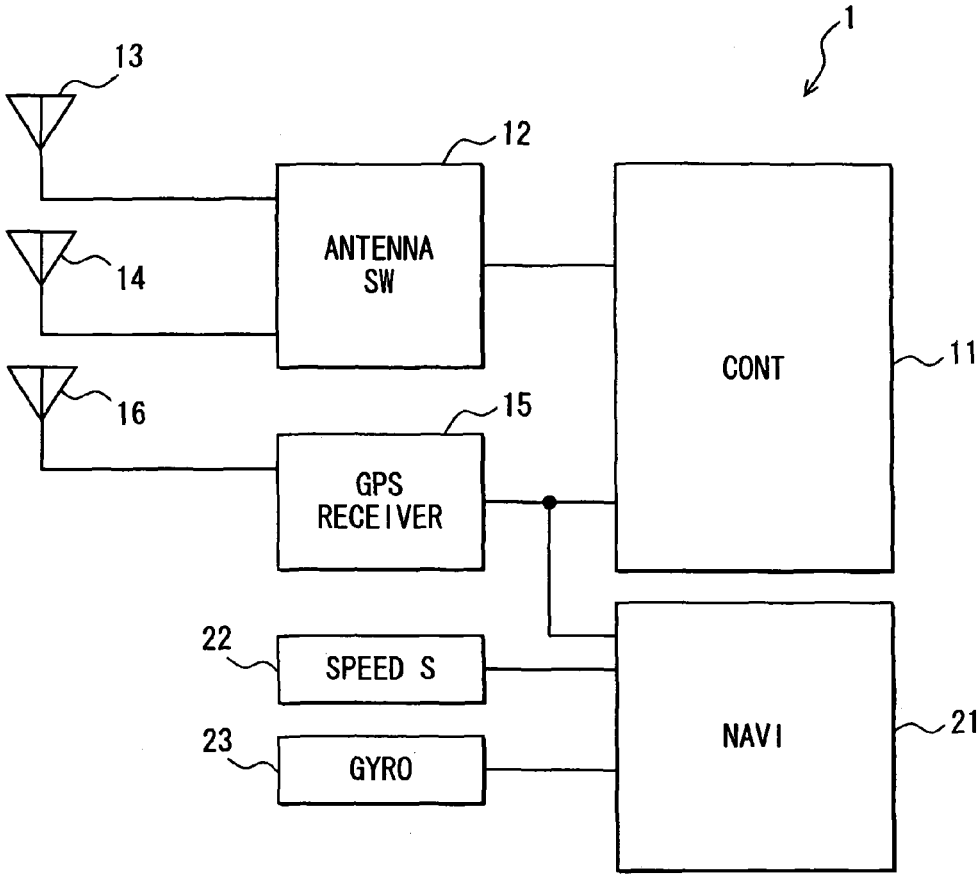
FIG. 1 is a circuit diagram showing a communication apparatus for inter-vehicle communication.

FIG. 1 shows a communication apparatus 1 for inter-vehicle communication. The apparatus 1 is mounted on, for example, a vehicle. The apparatus 1 communicates other communication apparatuses mounted on other vehicles so that positional information or the like is exchanged between the vehicle and the other vehicles. For example, the apparatus informs an occupant in the vehicle on position information of other vehicles or information about possibility of collision to other vehicles. Thus, the apparatus avoids collision with other vehicles. The apparatus may communicate with a device arranged around a road. The device detects a position of other vehicles, and the apparatus and the device communicate with each other so that the apparatus obtains positional information of other vehicles.

The apparatus 1 includes a controller 11 as a communication means, an antenna switch 12 as a switching means, a vertical polarized antenna 13, a horizontal polarized antenna 14, a GPS receiver 15 as a current position detecting means, a GPS antenna 16, a navigation device 21, a speed sensor 22 and a gyroscope 23.

The vertical polarized antenna 13 transmits and receives an electric wave having a polarization surface perpendicular to a ground surface. The horizontal polarized antenna 14 transmits and receives an electric wave having a polarization surface in parallel to the ground surface. The antenna switch 12 switches and selects between the horizontal polarized antenna 14 and the vertical polarized antenna 13 so that the electric wave is transmitted and received by selected one of the antennas 13, 14. The antenna switch 12 selects the antennas 13, 14 based on an instruction signal from the controller 11.

The GPS receiver 15 receives a signal transmitted from a GPS satellite via the GPS antenna 16. Based on the signal, the current position of the vehicle is detected. The detected position is input in the controller 11 and the navigation device 21.

The controller 11 is a micro-computer having a CPU, a ROM, a RAM and the like. The controller 11 executes various process according to a program stored in the ROM. The various process is, for example, a process for communicating between other vehicles via the antennas 13, 14, or a process for switching antennas 13, 14 with the antenna switch 12.

The information obtained from the communication with other communication apparatuses in other vehicles is, for example, information about a position and a vehicle speed of each vehicle. Here, the vehicle speed is defined as a moving vector. A frequency of the electric wave for utilizing the communication between the vehicle and the other vehicles is disposed in a UHF zone, so that the frequency of a carrier wave is, for example, 720 MHz.

The speed sensor 22 is a conventional speed sensor, and detects a vehicle speed of the vehicle. The information about the vehicle speed is transmitted from the speed sensor 22 to the navigation device 21. The gyroscope 23 is a conventional gyroscope, and detects an angular speed of the vehicle when the vehicle turns right or left. The information about the angular speed is transmitted from the gyroscope to the navigation device 21.

The navigation device 21 includes a database (not shown) for storing map data and a display (not shown). Based on signals from the GPS receiver 15, the speed sensor 22 and the gyroscope 23, the navigation device 21 detects the current position of the vehicle with high accuracy and displays the map image on the display together with the current position of the vehicle overlapped on the map image.

When the navigation device 21 receives the position information of other vehicles via the controller 11, the navigation device 21 displays the position information on the display. Further, when the possibility of collision with other vehicles increases, the device 21 informs of warning of collision.

Figure 2:
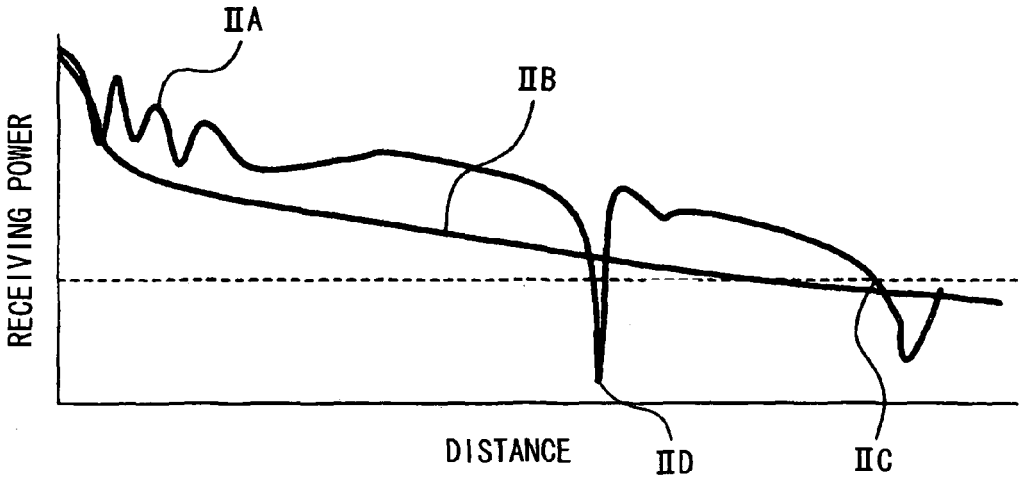
FIG. 2 is a graph showing a relationship between a distance and a receiving electric power.

The apparatus 1 executes the switching process for switching between the horizontal polarized antenna 14 and the vertical polarized antenna 13 with using the antenna switch 12. The reason why the apparatus switches the antennas 13, 14 will be explained as follows. FIG. 2 shows a relationship between a distance to other communication apparatus and a receiving electric power. In FIG. 2, IIA represents vertical polarized propagation property, and IIB represents horizontal polarized propagation property. IIC represents a communication limit point, and IID represents a dip point.

As shown in FIG. 2, the vertical polarized electric wave is transmitted and received by the vertical polarized antenna 13, and has the vertical polarized propagation property IIA. The horizontal polarized electric wave is transmitted and received by the horizontal polarized antenna 14, and has the horizontal polarized propagation property IIB. By comparing the vertical polarized propagation property IIA and the horizontal polarized propagation property IIB, the vertical polarized propagation property IIA has long distance to the communication limit point IIC so that the reaching distance of the vertical polarized electric wave is long. The reason why the communication limit distance of the vertical polarized propagation property IIA is longer than a communication limit distance of the horizontal polarized propagation property IIB is such that the vertical polarized electric wave is not affected by the ground surface, compared with the horizontal polarized electric wave, so that the attenuation of the vertical polarized electric wave is smaller than the attenuation of the horizontal polarized electric wave.

The horizontal polarized propagation property IIB has no dip point IID, at which the receiving electric power of the electric wave rapidly falls. Here, the receiving electric power is a signal level. However, the vertical polarized propagation property IIA has the dip point IID. The reason why the vertical polarized propagation property IIA has the dip point IID is such that the vertical polarized electric wave is much affected by a multiple path effect. The multiple path effect is caused by reflection of the electric wave on a building or the like. The multiple path effect may provide to amplify the electric wave so that the reaching distance of the vertical polarized electric wave becomes longer than that of the horizontal polarized electric wave.

At the dip point IID, the receiving electric power is reduced, so that the communication may be interrupted. In this case, by using the horizontal polarized electric wave, the signal level for performing the communication may be secured. In a case where the distance to the other vehicle is large, the possibility of communicating with the other vehicle is large when the apparatus 1 uses the vertical polarized electric wave.

Figure 3:
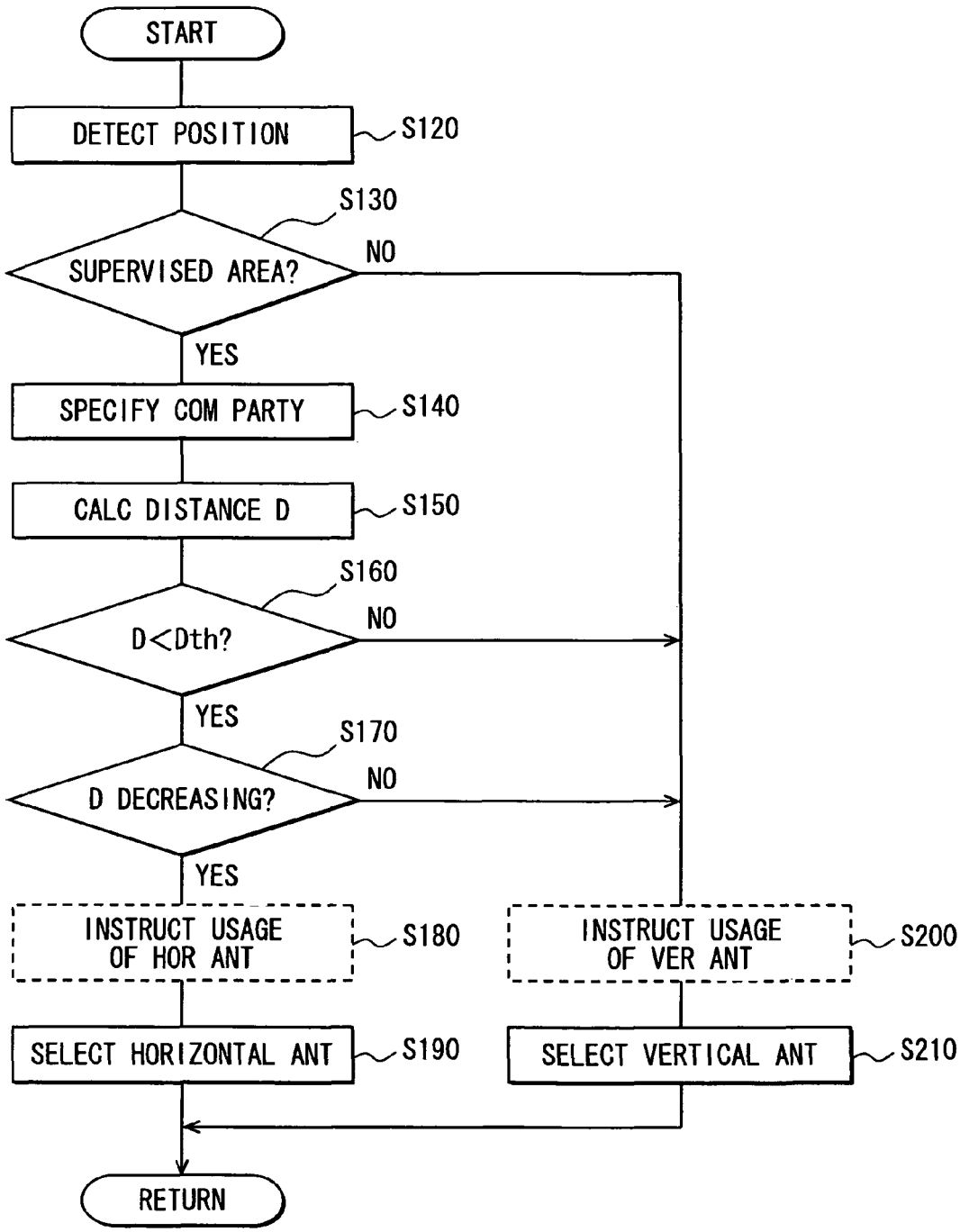
FIG. 3 is a flowchart showing an antenna switching process.

FIG. 3 shows an antenna switching process. By switching the antennas 13, 14 and by selecting one of antennas 13, 14 appropriately, both of the advantage of the horizontal polarized electric wave and the advantage of the vertical polarized electric wave are obtained. Here, the advantage of the vertical polarized electric wave is the long reaching distance, and the advantage of the horizontal polarized electric-wave is no dip point. The antenna switching process is performed by the controller 11. Steps S160 to S210 correspond to the switching control means.

The antenna switching process is executed repeatedly when an ignition switch (not shown) turns on. In an initial state, the antenna switch 12 selects the vertical polarized antenna 13. Firstly, the GPS receiver 15 detects the current position of the vehicle in Step S120.

In Step S130, the controller 11 determines whether the current position is disposed in a supervised area. The supervised area is, for example, an area near an intersection so that a distance to the intersection is within a distance to the communication limit point IIC. The controller 11 communicates with the navigation device 21 so that the information about the current position of the vehicle, information about a type of a road, on which the vehicle runs, information about a distance to an intersection, and information about a high accident area are obtained. Here, the type of the road includes an urban area road, a highway, a residential road or the like. Based on the information, the controller 11 determines whether the current position is disposed in a supervised area.

When the current position of the vehicle is not disposed in the supervised area, i.e., when it is determined as "NO" in Step S130, the controller 11 transmits an instruction for selecting the vertical polarized antenna 13 to the antenna switch 12 in Step S200. In Step S210, the antenna switch 12 selects the vertical polarized antenna 13. After that, the controller 11 repeats the antenna switching process. When the current position of the vehicle is disposed in the supervised area, i.e., when it is determined as "YES" in Step S130, the apparatus 1 specifies the other communication apparatus as the other communication party by detecting the electric wave transmitted from the other communication party via the selected antenna 13, 14 in Step S140. The apparatus 1 communicates with the other communication apparatus so that the information about the current position of the vehicle is exchanged between the apparatus 1 and the other communication apparatus. Thus, a distance D between the vehicle and the other vehicle is calculated according to the current position of each vehicle in Step S150. Step S150 corresponds to a relative distance monitoring means and a position information obtaining means.

In Step S1550, information about a traveling vector of each vehicle may be exchanged between the apparatus 1 and the other communication apparatus. In this case, in Step 150, it is possible to determine whether the relative distance D is increasing or decreasing. Further, when the apparatus 1 detects multiple other communication apparatuses in Step S140, Step S150 may be performed at each detected communication apparatus. Then, the apparatus 1 specifies one of the other communication apparatuses, which is disposed at a position having the minimum relative distance D, and the apparatus 1 performs Step S160 with the minimum relative distance D.

The communication system is, for example, a CDMA system. In this case, the apparatus 1 can communicate with multiple other communication apparatuses. Alternatively, the communication system may be a time division communication system such as a TDMA system by assigning a time slot to each communication apparatus so that the apparatus 1 can communicate with multiple other communication apparatuses. When the apparatus 1 communicates with multiple communication apparatuses, the apparatus 1 performs Step S160 at each communication apparatus.

In Step S160, the apparatus 1 determines whether the relative distance D is smaller than a predetermined distance threshold Dth. The distance threshold Dth is set to be slightly larger than the distance between the vehicle and the dip point. For example, the distance threshold Dth is 10 meters.

When the relative distance D is smaller than the distance threshold Dth, i.e., when it is determined as "YES" in Step S160, the apparatus 1 determines in Step S170 whether the relative distance D is decreasing. Here, in a case where the apparatus 1 exchanges information about the traveling vector of each vehicle in Step S150, the apparatus 1 can directly determine whether the relative distance D is decreasing. When the apparatus 1 exchanges information about the position of each vehicle in Step S150, the apparatus 1 can determine by repeating Step S150 so that the relative distance D is repeatedly detected, and thereby, the apparatus 1 determines whether the relative distance D is decreasing.

When the relative distance D is decreasing, i.e., when it is determined as "YES" in Step S170, the controller 11 instructs the antenna switch 12 to switch from the vertical polarized antenna 13 to the horizontal polarized antenna 14 in Step S190. Then, the apparatus 1 repeats the antenna switching process. Alternatively, in Step S180 before Step S190, the apparatus 1 may instruct the other communication apparatus to use the horizontal polarized antenna 14.

When the relative distance D is equal to or larger than the distance threshold Dth, i.e., when it is determined as "No" in Step 160, it proceeds to Step S210. Further, when the relative distance D is not decreasing, i.e., when it is determined as "NO" in Step S170, it proceeds to Step S210. In Step S210, the controller instructs the antenna switch 12 to select the vertical polarized antenna 13. Then, the apparatus 1 repeats the antenna switching process. Alternatively, in step S200 before Step S210, the apparatus 1 may instruct the other communication apparatus to use the vertical polarized antenna 13.

In the apparatus 1, the controller 11 performs the antenna switching process, so that the relative distance D between the vehicle and the other vehicle is monitored. When the relative distance D is equal to or larger than the distance threshold Dth, which is set to be larger than the distance to the dip point, the controller 11 instructs the antenna switch 12 to select the vertical polarized antenna 13. When the relative distance D is smaller than the distance threshold Dth, the controller 11 instructs the antenna switch 12 to select the horizontal polarized antenna 14.

Thus, when the relative distance D is equal to the distance to the dip point, the apparatus 1 utilizes the horizontal polarized electric wave so as to avoid the influence of the dip point. When the relative distance D is equal to or larger than the distance threshold Dth, which is set to be larger than the distance to the dip point, the apparatus 1 utilizes the vertical polarized electric wave so as to utilize the long reaching distance of the vertical polarized electric wave. Accordingly, the apparatus 1 can avoid the influence of the dip point without adding an additional circuit and increasing dimensions.

In the apparatus 1, the controller 11 communicates with other apparatuses by transmitting and receiving the electric wave in the UHF zone.

Since the apparatus 1 utilizes the horizontal polarized electric wave when the relative distance D is equal to the distance to the dip point, the apparatus 1 can secure sufficient receiving electric power that enables to communicate with other apparatuses.

Further, in the apparatus 1, the current position of the vehicle, on which the apparatus 1 is mounted, is detected by the GPS receiver 15 and/or the navigation device 21. The controller 11 obtains the information about the current position of the other vehicles in the antenna switching process. The controller 11 calculates the relative distance D based on the current position of the vehicle as a subjective vehicle and the current position of the other vehicles as an objective vehicle.

The apparatus 1 can calculate the relative distance D with high accuracy, compared with a case where the relative distance is calculated based on radio field strength of the electric wave or the like. Thus, when the relative distance D is equal to the distance to the dip point, the apparatus 1 can select the antenna 14 appropriately. The apparatus 1 can secure the sufficient receiving electric power for communication.

Figure 4:
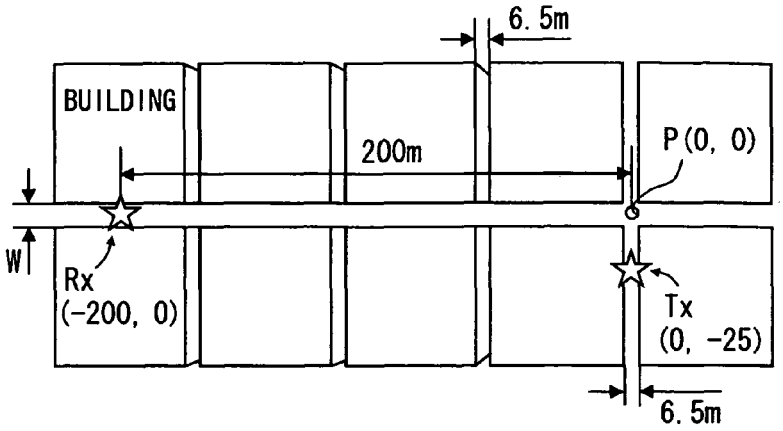
FIG. 4 is a bird eye view showing a simulation condition.

When the distance threshold Dth is set, it is necessary to preliminarily determine the distance to the dip point based on experiment or theory. In the present embodiment, the inventors study a simulation so as to obtain the distance to the dip point. FIG. 4 shows a bird eye view of buildings as an example of a simulation condition.

In FIG. 4, Rx represents a vehicle that receives the electric wave, and Tx represents the other vehicle that transmits the electric wave. The position of the receiver side vehicle Rx has coordinates of (−200, 0), and the position of the transmitting side vehicle Tx has coordinates of (0, −25). Thus, the receiving side vehicle Rx runs on a road between buildings. The transmitting side vehicle Tx is disposed in a blind zone of the receiving side vehicle Rx. Specifically, each building is made of concrete, and has dimensions of 50 m×50 m×20 m. A distance between adjacent buildings is 6.5 m. In FIG. 4, there are five buildings along with the road, on which the vehicle Rx runs. There are two buildings along with a direction perpendicular to the road, on which the vehicle Rx runs. The transmitting side vehicle Tx is arranged between the farthest building and the second farthest building on the right side of the receiving side vehicle Rx.

An intersection P between the road, on which the transmitting side vehicle Tx runs, and the road, on which the receiving side vehicle runs, is defined as an origin of the coordinates. Thus, the transmitting side vehicle Tx is arranged at the point Tx (0, −25), which is spaced apart from the intersection by 25 meters. The transmitting side vehicle Tx is not moved, i.e., fixed at the position Tx (0, −25) in this simulation condition.

The receiving side vehicle Rx moves between the point Rx (−200, 0) and the intersection, i.e., the point P (0, 0). The simulation zone is between the point Rx (−200, 0) and the point P (0, 0). Thus, the vehicle Rx travels 200 meters. Under this condition, the receiving electric power of the receiving side vehicle Rx is monitored. Here, the apparatus 1 in the receiving side vehicle Rx and the apparatus in the transmitting side vehicle Tx utilize the vertical polarized antenna 13.

Figure 5:
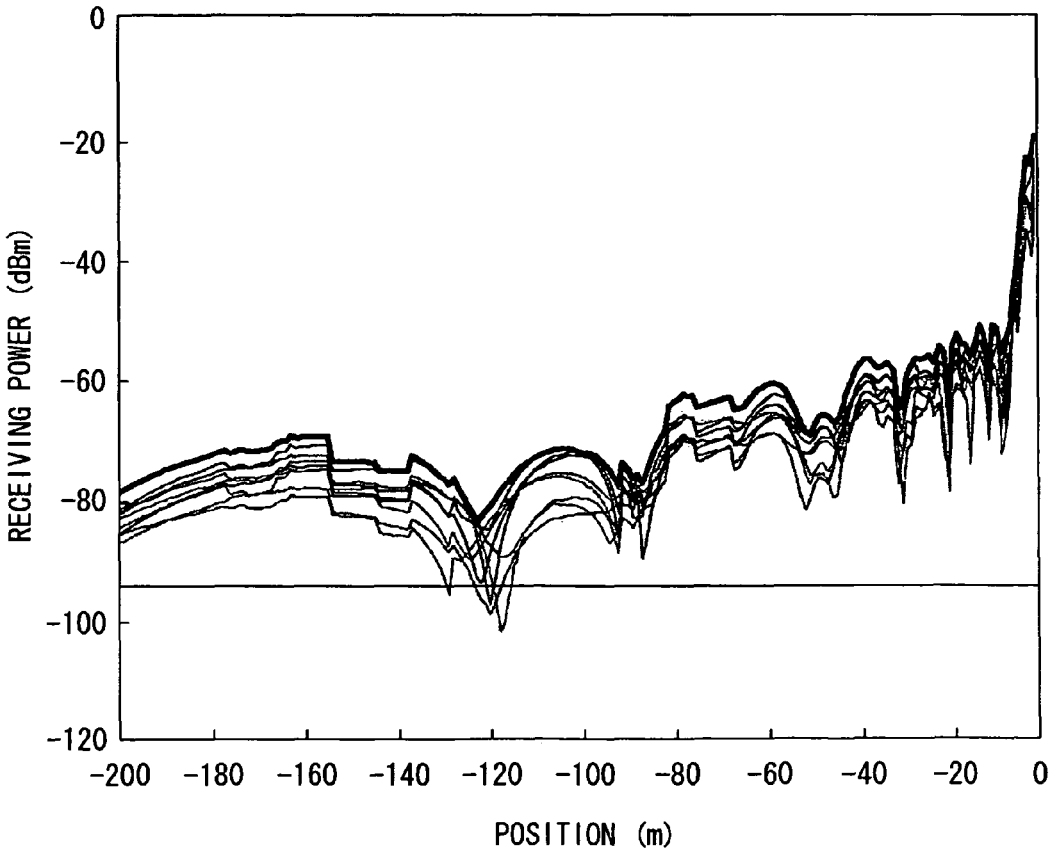
FIG. 5 is a graph showing a relationship between a vehicle position and a receiving electric power.

The transmitting electric power of the electric wave is 100 mW. The frequency of a carrier wave is 720 MHz. Further, the simulation is performed under various directionalities of each antenna 13 in the receiving side vehicle Rx and the transmitting side vehicle Tx. The simulation results are shown in FIG. 5.

According to the results, when the position of the receiving side vehicle Rx is changed, the receiving electric power is largely changed. When the minimum required receiving electric power to communicate with other vehicles is, for example, 94 dBm, the receiving electric power between the position of minus 110 meters and the position of minus 130 meters may be smaller than the minimum required receiving electric power to communicate with other vehicles. Accordingly, when the transmitting electric power of the electric wave is 100 mW, and the frequency of a carrier wave is 720 MHz, the distance threshold Dth is set to be 140 meters, which is larger than the distance from the transmitting side vehicle Tx to the dip point around minus 120 meters.

The distance to the dip point may be varied with the conditions such as the frequency. Thus, the distance threshold Dth may be changed with the frequency or the like.

While the invention has been described with reference to preferred embodiments thereof, it is to be understood that the invention is not limited to the preferred embodiments and constructions. The invention is intended to cover various modification and equivalent arrangements. In addition, while the various combinations and configurations, which are preferred, other combinations and configurations, including more, less or only a single element, are also within the spirit and scope of the invention.

What is claimed is:

1. A communication apparatus mounted on a vehicle and communicating with other apparatuses remote from the communication apparatus, comprising:

a switch for switching between a vertical polarized antenna and a horizontal polarized antenna, wherein the vertical polarized antenna transmits and receives an electric wave, which has a polarization surface perpendicular to a ground surface, and the horizontal polarized antenna transmits and receives the electric wave, which has another polarization surface in parallel to the ground surface;

a communication device for transmitting and receiving the electric wave via one of the vertical polarized antenna and the horizontal polarized antenna, which is selected by the switch;

a monitor for monitoring a relative distance between the communication apparatus and the other apparatuses; and a controller for controlling the switch in such a manner that the switch selects the vertical polarized antenna when the relative distance is equal to or larger than a distance threshold, and the switch selects the horizontal polarized antenna when the relative distance is smaller than the distance threshold, wherein the distance threshold is larger than a distance between the communication apparatus and a dip point.

2. The communication apparatus according to claim 1, wherein the communication device transmits and receives the electric wave in a UHF zone.

3. The communication apparatus according to claim 1, further comprising:

a position detector for detecting a current position of the vehicle; and an information obtaining device for obtaining information about a current position of the other apparatuses via the communication device, wherein the monitor calculates the relative distance based on the current position of the vehicle and the current position of the other apparatuses.

4. The communication apparatus according to claim 3, wherein the dip point is defined in such a manner that a receiving electric power of the vertical polarized antenna has a local minimal value at the dip point, and wherein the distance threshold is preliminarily determined according to a frequency of the electric wave.

5. A computer readable program storage medium containing instructions being readable and executed by a computer, the instructions for causing the computer to function as the communication apparatus according to claim 1.

* * * * *